US010722900B2

(12) United States Patent
Walton

(10) Patent No.: US 10,722,900 B2
(45) Date of Patent: Jul. 28, 2020

(54) PAPER SHREDDER

(71) Applicant: Arian Marie Walton, Carnation, WA (US)

(72) Inventor: Arian Marie Walton, Carnation, WA (US)

( * ) Notice: Subject to any disclaimer, the term of this patent is extended or adjusted under 35 U.S.C. 154(b) by 0 days.

(21) Appl. No.: 16/782,849

(22) Filed: Feb. 5, 2020

(65) Prior Publication Data

US 2020/0171505 A1 Jun. 4, 2020

Related U.S. Application Data

(63) Continuation-in-part of application No. 15/260,088, filed on Sep. 8, 2016, now Pat. No. 10,569,276.

(51) Int. Cl.

| | |
|---|---|
| ***B02C 23/20*** | (2006.01) |
| ***B02C 18/00*** | (2006.01) |
| ***B05B 1/14*** | (2006.01) |
| ***B05D 1/02*** | (2006.01) |
| ***B05D 5/10*** | (2006.01) |
| ***B02C 23/18*** | (2006.01) |

(52) U.S. Cl.
CPC ..... *B02C 18/0007* (2013.01); *B02C 23/18* (2013.01); *B05B 1/14* (2013.01); *B05D 1/02* (2013.01); *B05D 5/10* (2013.01); *B02C 2018/0061* (2013.01)

(58) Field of Classification Search
CPC ..... B30B 9/3035; B30B 9/3021; B02C 2018/0061; B02C 23/20
See application file for complete search history.

(56) References Cited

U.S. PATENT DOCUMENTS 3,754,498 A * 8/1973 Gil ..... B02C 18/0007 100/353
4,057,010 A * 11/1977 Smith ..... B30B 9/30 100/50
4,346,653 A * 8/1982 Rodak ..... B09B 1/00 100/116

* cited by examiner

*Primary Examiner* — Scott W Dodds
(74) *Attorney, Agent, or Firm* — Grossman, Tucker, Perreault & Pfleger, PLLC

(57) ABSTRACT

An apparatus for paper shredding and compacting which includes a shredded paper storage portion, a movable disposed within the shredded paper storage portion, and a movable push rod.

15 Claims, 6 Drawing Sheets

PAPER SHREDDER

CROSS REFERENCE TO RELATED APPLICATIONS

The Application is a Continuation-In-Part of Application having Ser. No. 15/260,088 filed on Sep. 8, 2016.

FIELD OF THE INVENTION

A paper shredder is disclosed, wherein the paper shredder comprises a compaction mechanism for shredded paper parts. In certain embodiments, the shredder is configured to dispose a pressure sensitive adhesive onto the paper parts prior to, or after, compaction.

BACKGROUND

Shredders range in size and price from small and inexpensive units designed for a certain amount of pages, to large units used by commercial shredding services that cost hundreds of thousands of dollars and can shred millions of documents per hour. Some shredders used by a commercial shredding service are built into a shredding truck.

SUMMARY

Disclosed is an apparatus for paper shredding and compacting. That apparatus comprises a housing comprising a moving parts portion, a shredded paper storage portion comprising a door, and an adhesive reservoir comprising one or more adhesives, a paper placement platform and a shredding knife assembly disposed within the moving parts portion The apparatus further comprises a movable ram and a movable push rod attached to said moveable ram, both disposed within said shredded paper storage portion. The moveable push rod is attached to the moveable ram.

The paper placement platform comprises a plurality adhesive spray nozzles, wherein one or more adhesives are sprayed onto each piece of paper as that piece of paper is moved from the paper placement platform into the shredding knife assembly.

DETAILED DESCRIPTION OF THE PREFERRED EMBODIMENTS

Applicant's article of manufacture is described in preferred embodiments in the following description with reference to the Figures, in which like numbers represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of Applicant's disclosure may be combined in any suitable manner in one or more embodiments. In the following description, numerous specific details are recited to provide a thorough understanding of embodiments of my invention. One skilled in the relevant art will recognize, however, that Applicant's disclosure may be practiced without one or more of the specific details, or with other methods, components, materials, and so forth. In other instances, well-known structures, materials, or operations are not shown or described in detail to avoid obscuring aspects of Applicant's disclosure, and it will be appreciated by those skilled in the art that it is intended to cover alternatives, modifications, and equivalents as may be included within the spirit and scope of Applicant's disclosure as defined by the appended claims and their equivalents as supported by the following disclosure and drawings.

Figure 1A:
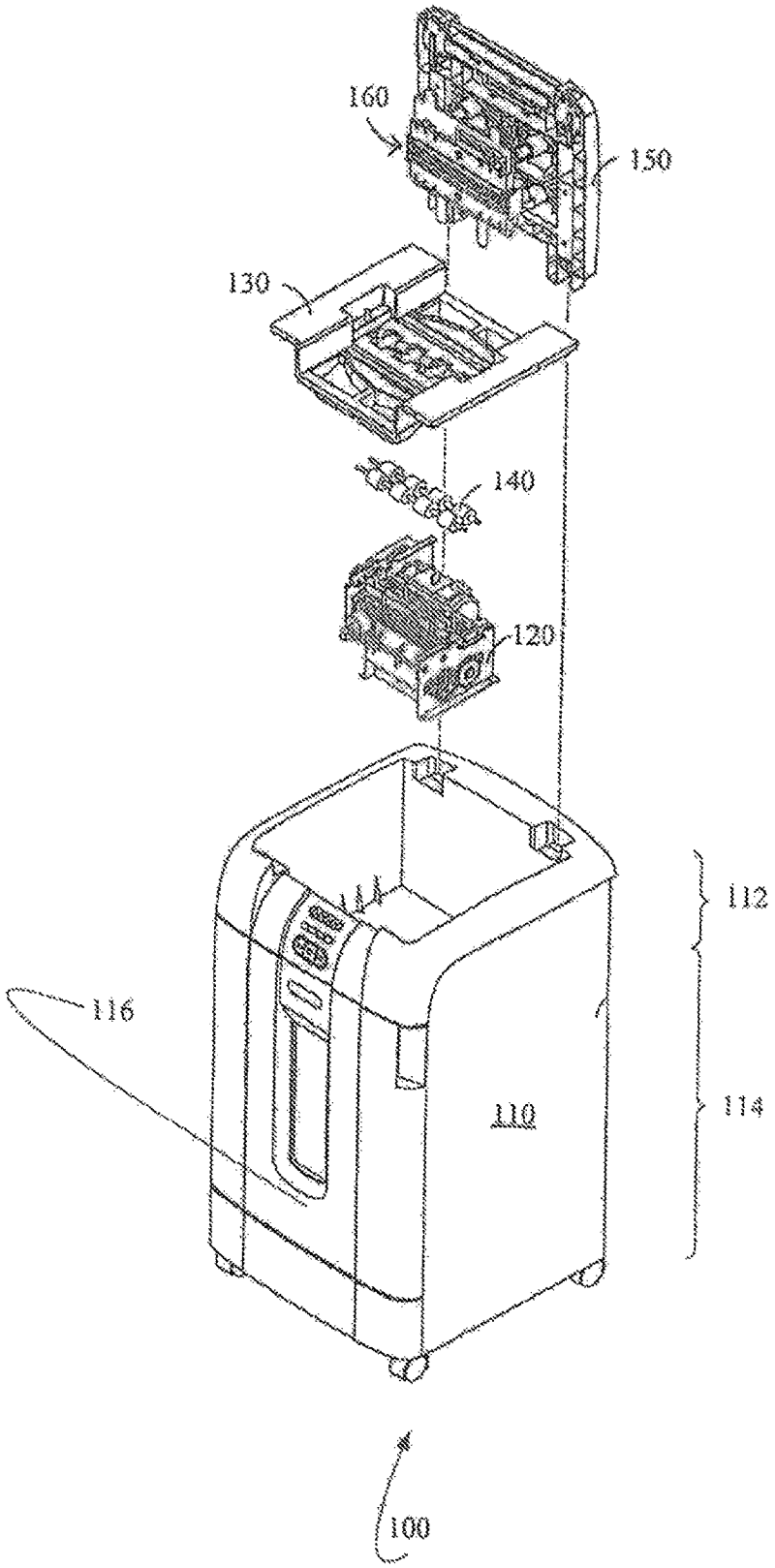
FIG. 1A is a schematic exploded view illustrating a paper shredder according to an embodiment of the present invention.

FIG. 1A illustrates an embodiment of Applicant's paper shredder. As shown in FIG. 1A, the paper shredder 100 comprises a housing 110. Housing 110 comprises a moving parts portion 112 and a shredded paper parts storage portion 114. A shredding knife assembly 120, a paper placement platform 130, a feeding roller assembly 140, an upper cover 150, and a pressing structure 160 are disposed in portion 112.

The shredding knife assembly 120 is disposed within the housing 110 for cutting a paper stack into plural small pieces (e.g. strips or fine particles). The paper placement platform 130 is disposed over the shredding knife assembly 120 for supporting the paper stack.

Figure 1B:
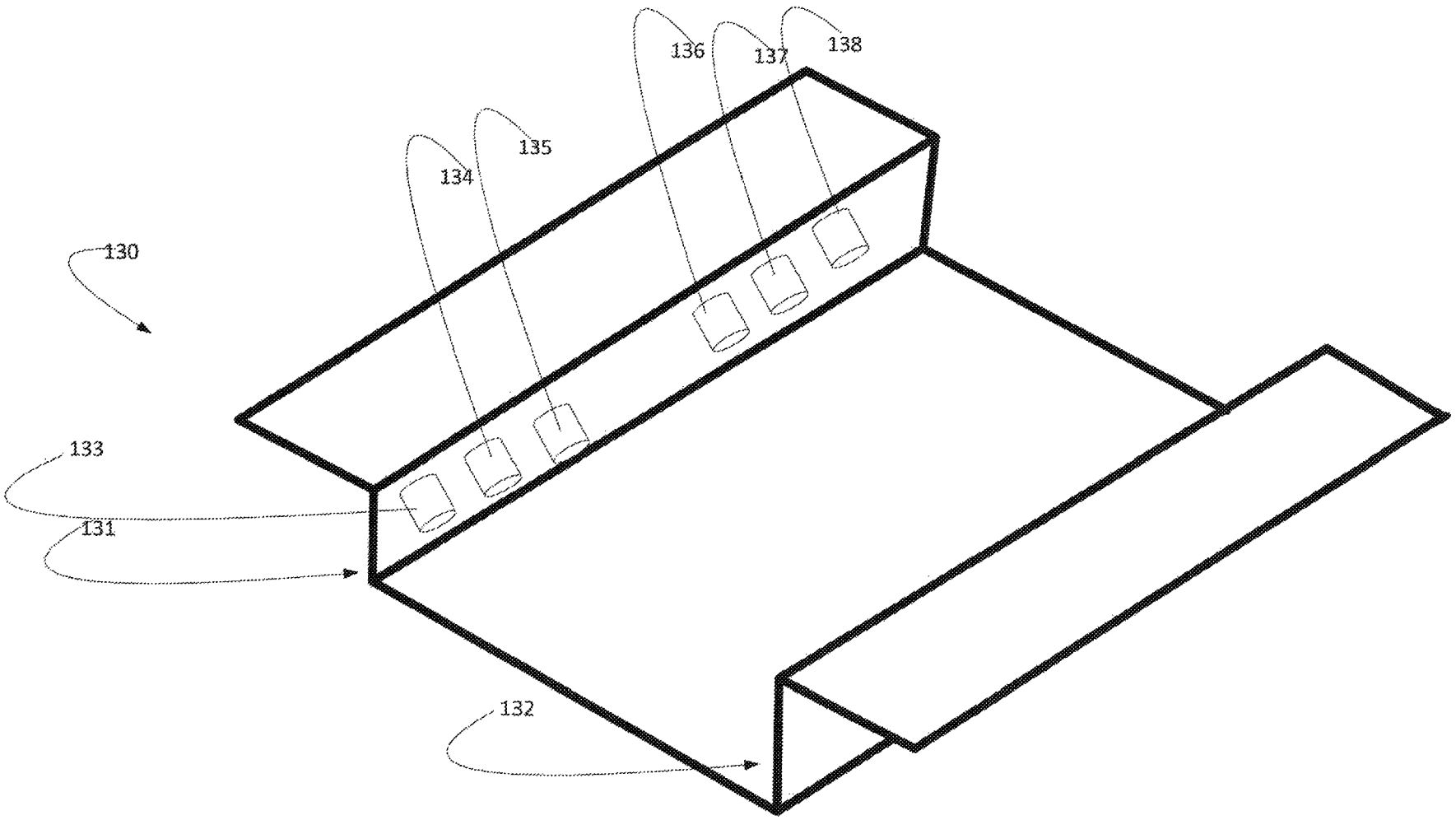
FIG. 1B illustrates element 130 from FIG. 1A in greater detail.

Referring now to FIG. 1B, in certain embodiments paper placement platform 130 comprises a plurality of spray nozzles from which one or more adhesives are disposed on each piece of paper before that piece of paper is feed into shredding knife assembly 120. More specifically, wall 131 of assembly 130 comprises a plurality of adhesive dispensing nozzles. In the illustrated embodiment of FIG. 1B, six (6) adhesive dispensing nozzles are disposed on an interior surface of wall 131, namely adhesive dispensing nozzles 134, 135, 136, 137, and 138. In other embodiments, wall 131 is formed to include more that 6 adhesive dispensing nozzles. In yet other embodiments, wall 131 is formed to include fewer that 6 adhesive dispensing nozzles.

In certain embodiments, an opposing wall 132 is also formed to comprise six (6) adhesive dispensing nozzles. In other embodiments, wall 132 is formed to include more that 6 adhesive dispensing nozzles. In yet other embodiments, wall 132 is formed to include fewer that 6 adhesive dispensing nozzles.

The feeding roller assembly 140 is arranged between the paper placement platform 130 and the shredding knife assembly 120.

In certain embodiments, Applicant's paper shredding assembly comprises a moveable power ram disposed in the shredded paper parts storage portion 114 (FIG. 1A) of Applicant's assembly. Further in the illustrated embodiment of FIG. 2, compaction system 200 comprises a hydraulic cylinder 210 having a piston 220 connected to a push rod 230. The push rod 230 is connected to a ram 310 (FIGS. 3A, 3B) moveably disposed in shredded paper parts storage area 114 of assembly 100. An opening, such as a door 116 is provided in housing 110 to permit removal of the compacted shredded paper parts.

The hydraulic cylinder 210 is actuated by the pressure from a fluid pump 240 through a three-way solenoid valve 290. The fluid pump 240 is driven by an electric motor 280. Energization of the three-way solenoid valve 290 is controlled by an electrical control unit (ECU) 250 in response to switch settings on a control panel 252 and the electrical power being applied to the electric motor 280. A current sensor 270 circumscribes one of the electrical leads to the electric motor 280 and generates a signal indicative of the current being consumed by the motor.

Figure 2:
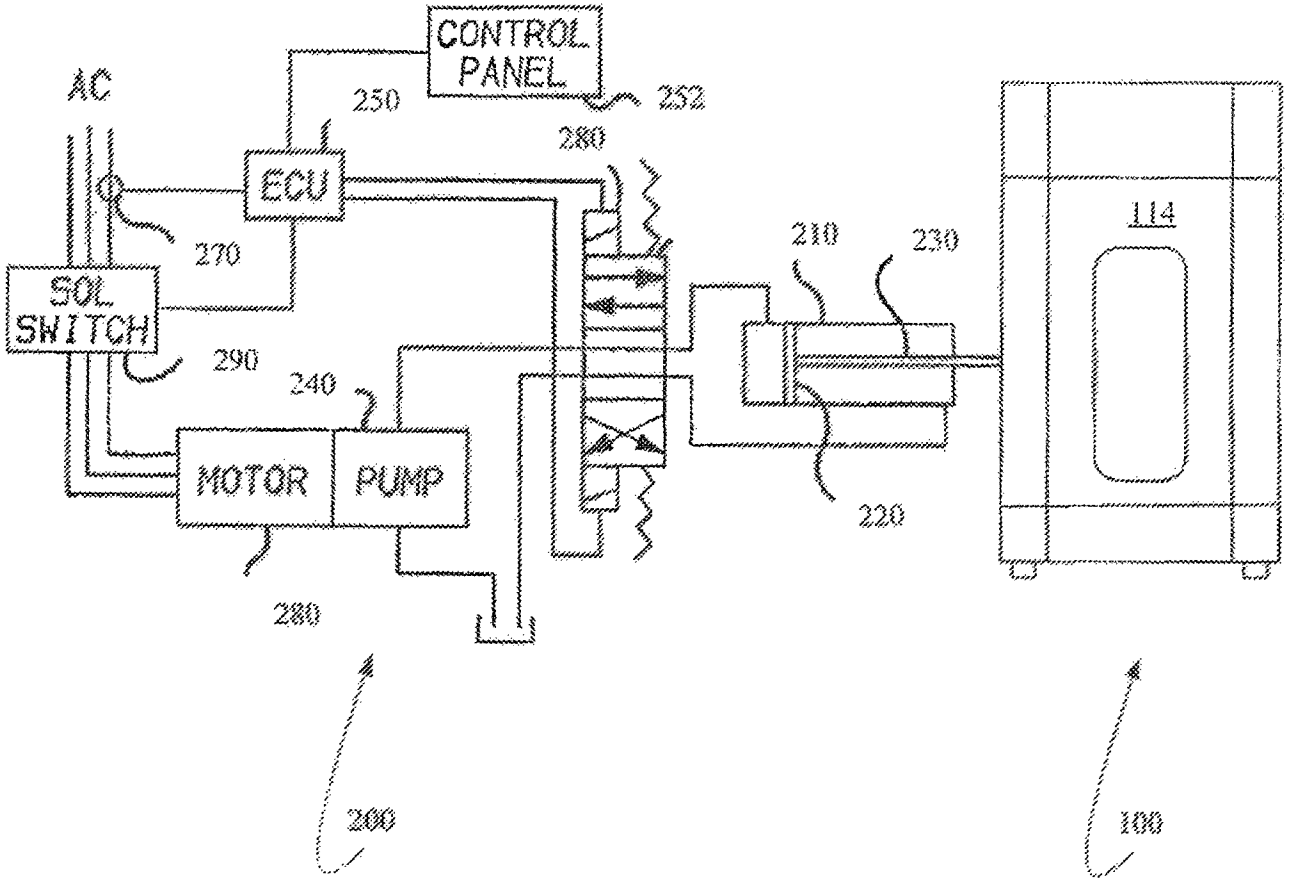
FIG. 2 illustrates a moveable power ram disposed in the shredded paper parts storage portion of Applicant's assembly.
Figure 3B:
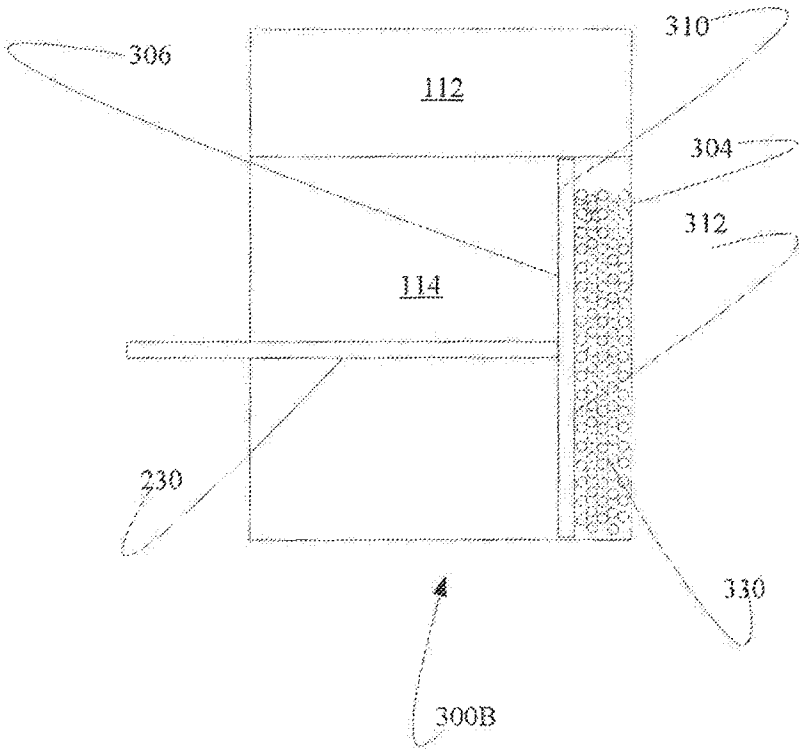
FIG. 3B shows power ram 310 in a compacting configuration.
Figure 3A:
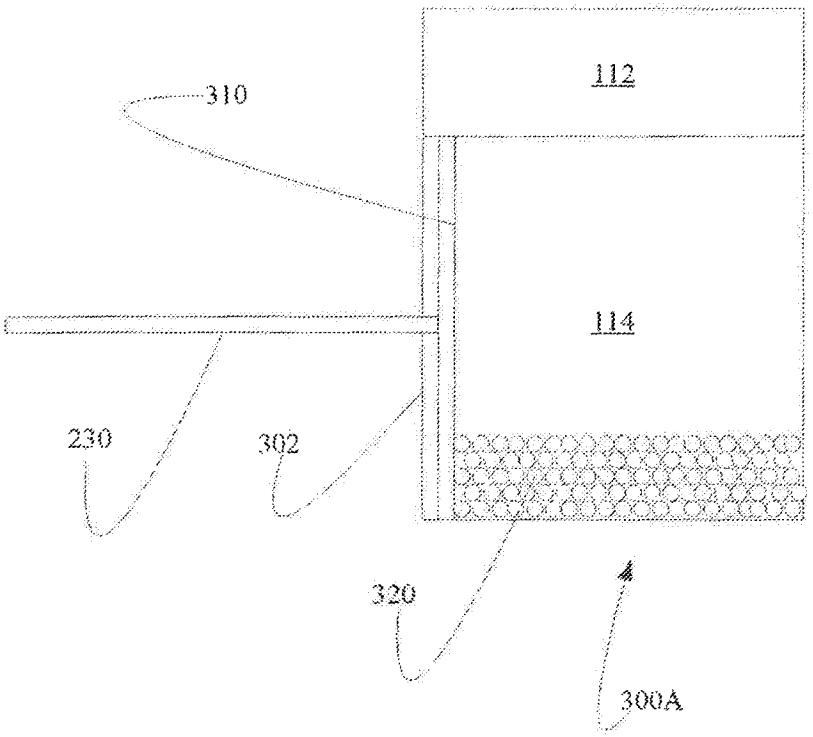
FIG. 3A is a cross-section view of Applicant's assembly 100 illustrating a push rod.

Referring now to FIGS. 3A and 3B, FIG. 3A is a cross-section view of Applicant's assembly 100 illustrating push rod 230 (FIGS. 2, 3A, 3B), wherein push road 230 is attached to power ram 310 disposed within shredded paper parts storage portion 114 (FIG. 1A), and wherein shredded paper parts 320 are disposed in shredded paper parts storage portion 114. In the illustrated embodiment of FIG. 3A, power ram 310 is shown in a non-compacting configuration. Shredded paper parts 320 comprise a first volume in the illustrated embodiment of FIG. 3A.

FIG. 3B shows power ram 310 in a compacting configuration, wherein face 312 of power ram 310 moves laterally from adjacent wall 302 of assembly 300A to a position intermediate wall 306 of assembly 300B and wall 304 of assembly 300B. In that process, the plurality of shredded paper parts 320 has been compacted to a plurality of compacted shredded paper parts 330 by power ram 310. Shredded paper parts 320 comprise a first volume in the illustrated embodiment of FIG. 3A. Compacted shredded paper parts 330 comprise a second volume in the illustrated embodiment of FIG. 3B. In certain embodiments, the first volume is two times the second volume. In certain embodiments, the first volume is three times the second volume.

Compacted shredded paper parts 330 can be removed from assembly 100 via door 116. (FIG. 1A).

In certain embodiments, Applicant's shredder assembly can spray a pressure sensitive adhesive onto the shredded paper parts. After the shredded paper parts are compacted, the pressure sensitive adhesive cures and the plurality of shredded paper parts are formed into a unitary mass of paper parts that have been glued together.

In certain embodiments, the pressure sensitive adhesive comprises a plurality of solid particles. In certain embodiments, the pressure sensitive adhesive comprises a liquid.

Pressure-sensitive adhesive (PSA, self-adhesive, self-stick adhesive) is adhesive which forms a bond when pressure is applied to marry the adhesive with the adherend. No solvent, water, or heat is needed to activate the adhesive.

As a general matter, Applicants pressure sensitive adhesive comprises an elastomer compounded with a suitable tackifier (e.g., a rosin ester). In certain embodiments, the elastomers can be based on: acrylics, which can have sufficient tack on their own to not require a tackifier; bio-based acrylate, which is formed by grafting a biological-based macromonomer onto a backbone of acrylate so that the resulting PSA uses 60% bio-based materials; butyl rubber; ethylene-vinyl acetate (EVA) with high vinyl acetate content; natural rubber; nitriles; and silicone rubbers, which require special tackifiers based on "MQ" silicate resins composing of a monofunctional trimethyl silane ("M") reacted with quadrafunctional silicon tetrachloride ("Q").

Further, the elastomers can be based on styrene block copolymers (SBCs). SBCs are also called styrene copolymer adhesives, which are rubber-based adhesives, and have good low-temperature flexibility, high elongation, and high heat resistance. SBCs possess the mechanical properties of rubbers and characteristics of thermoplastics due to their molecular structures. SBCs usually have A-B-A structures, with an elastic rubber segment between two rigid plastic endblocks. The A-B-A structure promotes a phase separation of the polymer, binding together the endblocks, with the central elastic parts acting as cross-links. SBC's versatility is displayed in being used in hot melt adhesive applications, where the composition retains tack even when solidified, and in non-pressure-sensitive formulations are also used. Further, SBCs are high-strength film formers, which can be used as standalone compositions; whereas, SBCs increase cohesion and viscosity when they are used as an additive. Moreover, SBCs are water-resistant, but are soluble in some organic solvents and cross-linking improves SBC's solvent resistance. In addition, the resins used to make SBC-based hot melt adhesives fall into two categories: end-block modifiers and mid-block modifiers. The endblocks modifying resins (cumarone-indene, α-methyl styrene, vinyl toluene, aromatic hydrocarbons, etc.) improve adhesion and alter viscosity; whereas the midblocks modifying resins (aliphatic olefins, rosin esters, polyterpenes, terpene phenolics) improve adhesion, processing and pressure-sensitive properties.

Moreover, the elastomers can be based on styrene-butadiene-styrene (SBS), which is used in high-strength PSA applications; styrene-ethylene/butylene-styrene (SEBS), which is used in low self-adhering non-woven applications; styrene-ethylene/propylene (SEP); and styrene-isoprene-styrene (SIS), which is used in low-viscosity high-tack PSA applications; and vinyl ethers.

In other embodiments, Applicant's shredder assembly can spray a HMA onto the shredded paper. During compaction, the HMA melts and adheres to the plurality of shredded paper parts. In certain of these embodiments, Applicant's shredder assembly further comprises a heated compaction piston which facilitates melting of the HMA. As the shredded paper parts having adhesive particles disposed thereon are heated, the HMA melts and cures to form an elastomeric binder that binds all the shredded paper into a rubberized shape. Referring to FIGS. 3A and 3B, the inside lining of the shredded paper parts storage portion 114 is configured to be heat resistant and inert so that the HMA will not melt or react with the inside lining of the shredded paper parts storage portion 114.

In certain embodiments, Applicant's apparatus utilizes one or more of the following polymeric materials.

Ethylene-vinyl acetate (EVA) copolymers are low-cost and most common materials for glue sticks (e.g., the light amber colored Thermogrip GS51, GS52, and GS53). They provide sufficient strength between 30 and 50° C. but are limited to use below 60-80° C. and have low creep resistance under load. EVA can be compounded into a wide range of HMAs, from soft pressure-sensitive adhesives to rigid structural adhesives for furniture construction. The vinyl acetate monomer content is generally about 18-29 percent by weight of the polymer. However, the composition of the EVA copolymer can be changed to influence its properties: increased content of ethylene promotes adhesion to nonpolar substrates such as polyethylene; higher ethylene content also increases mechanical strength, block resistance, and paraffin solubility; increased content of vinyl acetate promotes adhesion to polar substrates such as paper; higher vinyl acetate content provides higher flexibility, adhesion, hot tack, and better low-temperature performance. Further, high vinyl acetate content can formulate a hot-melt pressure-sensitive adhesive (HMPSA) and adhesive grade EVA usually contains 14-35% vinyl acetate. Moreover, increased ratio of vinyl acetate lowers the crystallinity of the material, improves optical clarity, flexibility and toughness, and worsens resistance to solvents. EVA copolymers are often used with high amounts of tackifiers and waxes. An example composition is 30-40% of EVA copolymer (provides strength and toughness); 30-40% of tackifier resin (improves wetting and tack); 20-30% of wax (usually paraffin-based; reduces viscosity, alters setting speed, reduces cost), and 0.5-1% of stabilizers. In addition, fillers can be added for special applications. For example, EVA copolymers can be formulated for service temperatures ranging from −40 to +80° C., and for both short and long open times, and a wide range of melt viscosities; suitable stabilizers can be added to develop high stability at elevated temperatures and resistance to ultraviolet radiation. EVA can be crosslinked by, e.g., peroxides, yielding a thermosetting material. EVAs can be compounded with aromatic hydrocarbon resins. Grafting butadiene to EVA improves its adhesion. Cryogenic grinding of EVAs can provide small, water-dispersible particles for heat-seal applications. Lower molecular weight chains of EVA copolymers provide lower melt viscosity, better wetting, and better adhesion to porous surfaces; whereas higher molecular weight chains of EVA copolymers provide better cohesion at elevated temperatures and better low-temperature behavior. EVA can degrade primarily by loss of acetic acid and formation of a double bond in the chain, and by oxidative degradation.

Ethylene-acrylate copolymers have lower glass transition temperature and higher adhesion compared to EVA. They have better thermal resistance and increased adhesion to metals and glass. They are suitable for low temperature use. Ethylene-vinyl acetate-maleic anhydride and ethylene-acrylate-maleic anhydride terpolymers offer very high performance. Examples are ethylene n-butyl acrylate (EnBA), ethylene-acrylic acid (EAA), and ethylene-ethyl acetate (EEA).

Polyolefins (PO) family, which is difficult-to-bond plastics, includes polyethylene (PE), which further includes low density PE (LDPE) and high density PE (HDPE) with higher melting point and better temperature resistance; polybutene-1 (PB-1); oxidized polyethylene; amorphous polyolefin (APO/APAO); and etc. POs can serve as a good moisture barrier and have chemical resistance against polar solvents and solutions of acids, bases, and alcohols. POs have longer open time during application in comparison with EVA and polyamides and have low surface energy and provide good wetting of most metals and polymers. POs made by metallocene catalyzed synthesis have narrow distribution of molecular weight and correspondingly narrow melting temperature range. Lower molecular weights provide better low-temperature performance and higher flexibility, higher molecular weights increase the seal strength, hot tack, and melt viscosity. PE and APP are usually used on their own or with just a small amount of tackifiers (usually hydrocarbons) and waxes (usually paraffins or microcrystalline waxes to lower cost, improve anti-blocking, and alter open time and softening temperature). Due to the relatively high crystallinity, polyethylene-based glues tend to be opaque and, depending on additives, white or yellowish. PE based HMAs have high pot life stability, are not prone to charring, and are suitable for moderate temperature ranges and on porous non-flexible substrates. Further, nitrogen or carbon dioxide can be introduced into the PE based HMAs, forming a foam which increases spreading and open time and decreases transfer of heat to the substrate allowing use of more heat-sensitive substrates. PB-1 and its copolymers are soft and flexible, tough, partially crystalline, and slowly crystallizing with long open times during application. The low temperature of recrystallization allows for stress release during formation of the bond. PB-1 provides good bonding to nonpolar surfaces but worse bonding to polar ones, therefore it is suitable for rubber substrates. Further, PB-1 can be formulated as pressure-sensitive.

APOs tend to have lower melt viscosity, better adhesion, longer open times and slow set times than comparable EVAs. APO polymers are compatible with many solvents, tackifiers, waxes, and polymers; therefore, they are compounded with tackifiers, waxes, and plasticizers (e.g., mineral oil, poly-butene oil) often and are found in wide use in many adhesive applications. Examples of APOs include amorphous (atactic) propylene (APP), amorphous propylene/ethylene (APE), amorphous propylene/butene (APB), amorphous propylene/hexene (APH), amorphous propylene/ethylene/butene. APP is harder than APE, which is harder than APB, which is harder than APH, in accordance with decreasing crystallinity. APO HMAs are tacky, soft, and flexible and have good fuel and acid resistance, moderate heat resistance, and good adhesion and longer open times than crystalline POs. Further, APOs show relatively low cohesion and the entangled polymer chains have fairly high degree of freedom of movement. Under mechanical load, most of the strain is dissipated by elongation and disentanglement of polymer chains, and only a small fraction reaches the adhesive-substrate interface.

Polyamides, such as high-performance Polyamides (HPPA), are high-performance polymers for severe environments. They can be formulated as soft and tacky or as hard and rigid. They can be used as high-temperature glues with typical application at over 200° C. However, they can degrade and char during certain processing. For example, in molten state they can somewhat degrade by atmospheric oxygen. Polyamides have a high range of service temperatures: they generally show adequate bonding from −40 to 70° C.; and some compositions allow operation at 185° C. if they do not have to carry load. Since polyamides are resistant to plasticizers, polyamides derived from secondary diamines are suitable for gluing polyvinyl chloride. Further, polyamides have good adhesion to many substrates, such as metal, wood, vinyl, ABS, and treated polyethylene and polypropylene. They are also resistant to oils and gasoline. Some polyamides formulations are Underwriters Laboratories (UL)-approved for electrical applications requiring reduced flammability. Three groups are employed, with low, intermediate, and high molecular weight; the low MW ones are low-temperature melting and easy to apply, but have lower tensile strength, lower tensile-shear strength, and lower elongation than the high-MW ones; the high-MW ones require sophisticated extruders and are used as high-performance structural adhesives. The presence of hydrogen bonds between the polymer chains gives polyamides a high strength at even low molecular weights, in comparison with other polymers. Hydrogen bonds also provide retention of most of the adhesive strength up almost to the melting point; however they also make the material more susceptible to permeation of moisture in comparison with polyesters. Polyamides absorbs moisture, which may lead to foaming during application as water evaporates during melting and leaving voids in the adhesive layer which degrades mechanical strength. Further, polyamide HMAs are usually composed of a dimer acid with often two or more different diamines. The dimer acid usually presents 60-80% of the total polyamide mass and provides amorphous nonpolar character. Linear aliphatic amines such as ethylene diamine and hexamethylene diamine, provide hardness and strength. Whereas longer chain dimer acid and dimer acid amines, such as dimer amine, reduce the amount of hydrogen bonds per volume of material, resulting in lower stiffness. For example, polyether diamines provide good low-temperature flexibility; piperazine and similar diamines also reduce the number of hydrogen bonds. Only polyamides based on piperazine and similar secondary amines form satisfactory bond with polyvinyl chloride because primary amines form stronger hydrogen bonds within the adhesive; whereas secondary amines can act only as proton acceptors and cannot form hydrogen bonds within the polyamide, and are therefore free to form weaker bonds with vinyl, probably with the hydrogen atom adjacent to the chlorine.

Polyesters, which are similar to the ones used for synthetic fibers and have high application temperature, are synthetized from a diol and a dicarboxylic acid. Polyesters are often highly crystalline, leading to narrow melting temperature range, which is advantageous for high-speed bonding. The length of the diol chain has major influence to the material's properties. When diol chain length increases, the melting point of polyesters increases, the crystallization rate of polyesters increases, and the degree of crystallization of polyesters decreases. Both the diol and the acid groups influence the melting point. In comparison with similar polyamides, due to absence of hydrogen bonds, polyesters have lower strength and melting point, but are much more resistant to moisture, though still susceptible. In other parameters, and in applications where these factors do not play a role, polyesters and polyamides are very similar. Polyesters are often used for bonding fabrics. They can be used on their own, or blended with large amounts of additives. They are used where high tensile strength and high temperature resistance are needed. Most polyester based HMAs have high degree of crystallinity. By addition of sodium sulfonate groups for dispersibility, polyesters can be water-dispersible amorphous polymers, such as sulfopolyesters, and were developed for repulpable adhesives.

Thermoplastic polyurethane (TPU) offers good adhesion to different surfaces due to presence of polar groups. Its low glass transition temperature provides flexibility at low temperatures. They are highly elastic and soft with wide possible crystallization and melting point ranges. TPUs consist of long linear chains with flexible and soft segments (diisocyanate-coupled low-melting polyester or polyether chains) alternating with rigid segments (diurethane bridges resulting from diisocyanate reacting with a small-molecule glycol chain extender). The rigid segments form hydrogen bonds with rigid segments of other molecules. Higher ratio of soft to hard segments provides better flexibility, elongation, and low-temperature performance, but also lower hardness, modulus, and abrasion resistance. The bonding temperature is lower than with most other HMAs, only about 50-70° C., when the adhesive behaves as a soft rubber acting as a pressure-sensitive adhesive. The surface wetting in TPUs' amorphous state is good, and on cooling the polymer crystallizes, forming a strong flexible bond with high cohesion. Choice of a proper diisocyanate and polyol combination allows tailoring the TPU properties. Further, they can be used on their own or blended with a plasticizer since they are compatible with most common plasticizers and many resins.

Polyurethanes (PUR), or reactive urethanes, are suitable for high temperatures and have high flexibility. Solidification of PURs can be rapid or extended in range of several minutes. Then, secondary curing of PURs with atmospheric or substrate moisture continues for several hours, forming cross-links in the polymer. PURs have excellent resistance to solvents, chemicals, ink, and low application temperature and are suitable for heat-sensitive substrates. After curing, PURs are heat-resistant, with service temperatures generally from −30° C. to +150° C. PURs are often used in bookbinding, automotive, aerospace, filter, and plastic bag applications. They are susceptible to UV degradation causing discoloring and degradation of mechanical properties, thus, blending with UV stabilizers and antioxidants are required. Further, PURs can be produced combining prepolymers made of polyols and methylene diphenyl diisocyanate (MDI) or other diisocyanate with small amount of free isocyanate groups, which react and cross-link when subjected to moisture. The uncured solidified "green" polymers' strength tends to be lower than non-reactive HMAs' since mechanical strength of PURs develops with curing. Green strength can be improved by blending the prepolymer with other polymers.

SBCs, also called styrene copolymer adhesives and rubber-based adhesives, have good low-temperature flexibility, high elongation, and high heat resistance. As mentioned previously, SBCs are frequently used in pressure-sensitive adhesive applications, where the composition retains tack even when solidified; however, non-pressure-sensitive formulations are also used since SBCs have high heat resistance and good low-temperature flexibility.

Additional examples include styrene-isoprene-styrene (SIS), which is used in low-viscosity high-tack PSA applications; styrene-ethylene/butylene-styrene (SEBS), which is used in low self-adhering non-woven applications; and styrene-ethylene/propylene (SEP).

Further, the examples include polycaprolactone with soy protein, using coconut oil as plasticizer, forms a biodegradable hot-melt adhesive; polycarbonates; fluoropolymers, with tackifiers and ethylene copolymer with polar groups; silicone rubbers, undergo cross-linking after solidification, form durable flexible UV and weather resistant silicone sealant; thermoplastic elastomers; polypyrrole (PPY), a conductive polymer, for intrinsically conducting hot melt adhesives (ICHMAs), used for EMI shielding; and EVA compounded with 0.1-0.5 wt. % PPY are strongly absorbing in near infrared, allowing use as near-infrared activated adhesives.

The usual additives are:

Tackifying resins (e.g., rosins and their derivates, terpenes and modified terpenes, aliphatic, cycloaliphatic and aromatic resins, e.g., C5 aliphatic resins, C9 aromatic resins, and C5/C9 aliphatic/aromatic resins), hydrogenated hydrocarbon resins, and their mixtures, terpene-phenol resins (TPR, used often with EVAs). Up to about 40% tackifiers tend to have low molecular weight, with glass transition and softening temperature above room temperature, providing them with suitable viscoelastic properties. Tackifiers frequently present most of both weight percentage and cost of the hot-melt adhesive.

Waxes, e.g., microcrystalline waxes, fatty amide waxes or oxidized Fischer-Tropsch waxes; increase the setting rate. As one of the key components of formulations, waxes lower the melt viscosity and can improve bond strength and temperature resistance.

Plasticizers, e.g., benzoates such as 1,4-cyclohexane dimethanol dibenzoate, glyceryl tribenzoate, or pentaerythritol tetrabenzoate; phthalate; paraffin oils; polyisobutylene; chlorinated paraffins; and etc., can be used to reduce interactions between segments of polymer chains and decrease melt viscosity and elastic modulus.

Antioxidants and stabilizers, e.g., hindered phenols, BHT, phosphites, phosphates, hindered aromatic amines, can be added in small amounts (<1%) without influencing physical properties. These compounds protect the material from degradation both during service life, compounding, and in molten state during application. Stabilizers based on functionalized silicones have improved resistance to extraction and outgassing.

Addition of ferromagnetic particles, hygroscopic water-retaining materials, or other materials can yield a microwave heating activated HMA. Moreover, addition of electrically conductive particles can yield conductive hot-melt formulations.

Figure 4:
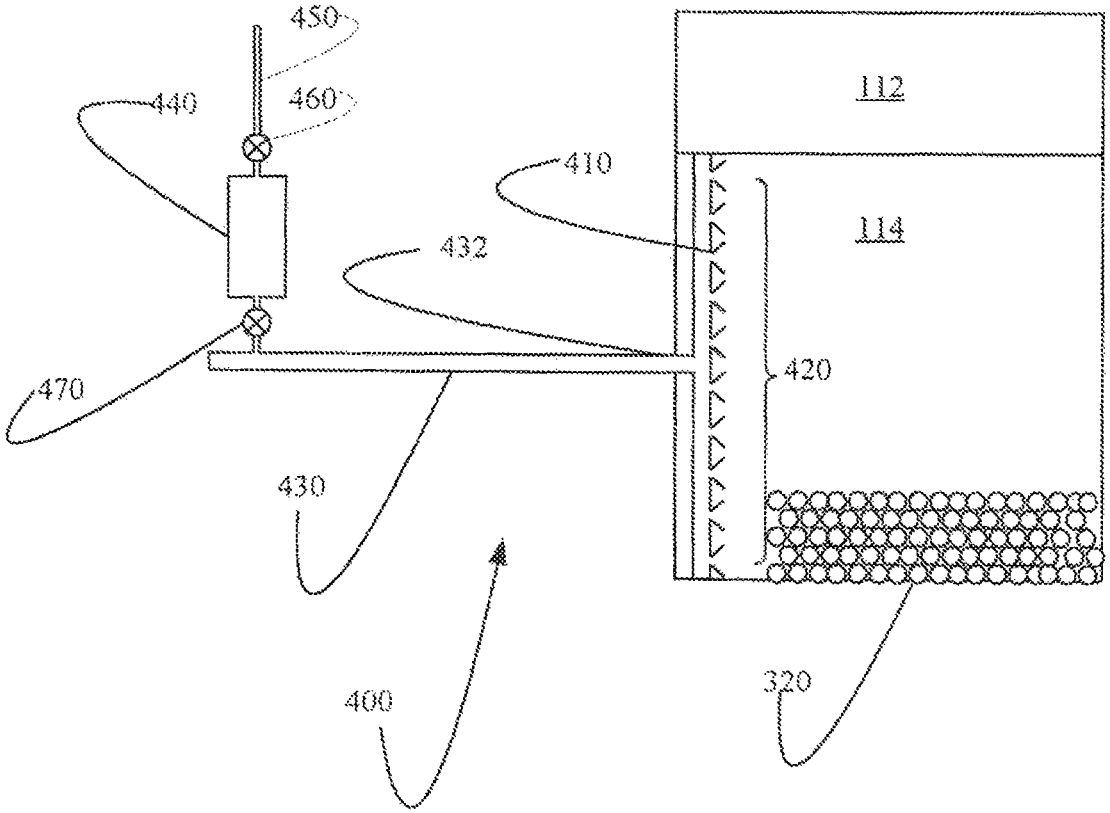
FIG. 4 illustrates assembly 400 comprising a tubular push rod which, in certain embodiments, is in fluid communication with power ram 410.

In the illustrated embodiment of FIG. 4, assembly 400 comprises a tubular push rod 430 which is in fluid communication with power ram 410. Power ram 410 is formed to include an enclosed space in fluid communication with tubular push rod 430. In the illustrated embodiment of FIG. 4, a plurality of spray nozzles 420 are disposed on an outer surface of power ram 410, and are in fluid communication with tubular push rod 430.

An adhesive reservoir 440 is in fluid communication with valve 460 which is in fluid communication with tubular push rod 430. In certain embodiments, adhesive reservoir 440 comprises an adhesive cartridge, which is replaceable upon depletion of the adhesive contained inside the cartridge. In certain embodiments, assembly 400 further comprises a pressurized gas source line 450 which is in fluid communication with valve 460 which is in fluid communication with adhesive reservoir 440. Opening valves 460 and 470 cause pressurized gas to convey adhesive from adhesive reservoir 440, through tubular push rod 430, through power ram 410, outwardly from a plurality of spray nozzles 420, and onto non-compacted shredded paper parts 320.

In certain embodiments, distal end 432 of tubular push rod 430 is interconnected to push rod 230 (FIG. 2). In other embodiments, a handle is attached to distal end 432 of tubular push rod 430, wherein compaction of the shredded paper parts is effected manually by physically pushing tubular push rod 430 into housing portion 114 of shredder assembly 400.

Figure 5:
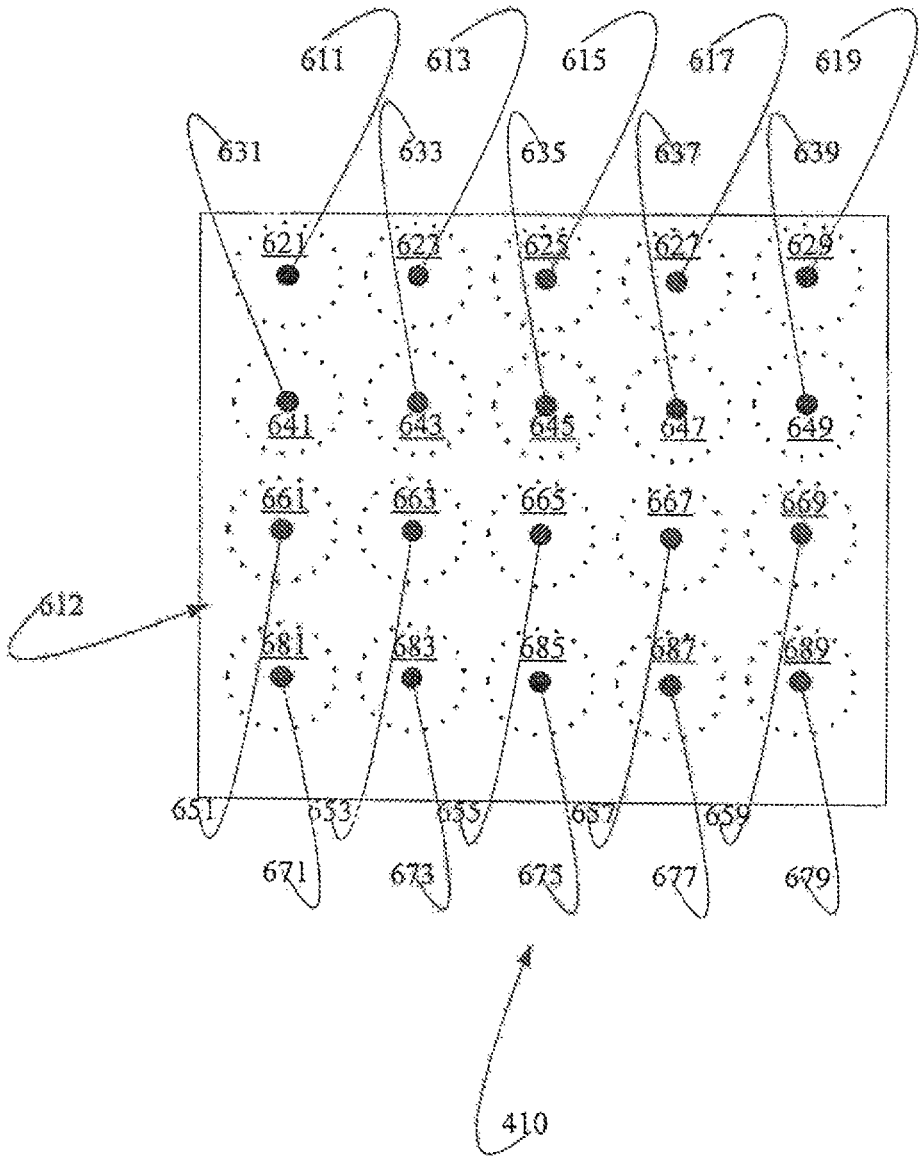
FIG. 5 illustrates exterior surface 612 of power ram 410.

FIG. 5 shows exterior surface 612 of power ram 410. Exterior surface 612 corresponds to exterior surface 312 (FIG. 3B) of power ram 310 (FIGS. 3A, 3B). In certain embodiments, exterior surface 612 is formed to include a plurality of spray nozzles. In the illustrated embodiment of FIG. 5, exterior surface 612 is formed to include nozzles 611, 613, 615, 617, 619, 631, 633, 635, 637, 639, 651, 653, 655, 657, 659, 671, 673, 675, 677, and 679. These nozzles define a plurality of spray patterns 621, 623, 625, 627, 629, 641, 643, 645, 647, 649, 661, 663, 665, 667, 669, 681, 683, 685, 687, and 689, respectively.

In certain embodiments, exterior surface 612 comprises a heated metal platen. In certain embodiments, the heated platen comprises an electrical heater. In certain embodiments, the heated platen comprises a hot oil heater.

While the preferred embodiments of the present invention have been illustrated in detail, it should be apparent that modifications and adaptations to those embodiments may occur to one skilled in the art without departing from the scope of the present invention.

I claim:

1. An apparatus for paper shredding and compacting, comprising:

a housing comprising a moving parts portion, a shredded paper storage portion comprising a door, and an adhesive reservoir comprising one or more adhesives;

a paper placement platform and a shredding knife assembly disposed within said moving parts portion;

a movable ram and a movable push rod attached to said moveable ram, both disposed within said shredded paper storage portion;

wherein:

said paper placement platform comprises a plurality adhesive spray nozzles;

adhesive is sprayed onto each piece of paper as that piece of paper is moved from said paper placement platform into said-shredding knife assembly;

and said door is used to remove compacted shredded paper.

2. The apparatus of claim 1, wherein said movable ram compacts shredded paper within said shredded paper storage portion from a first volume to a second volume to form said compacted shredded paper, wherein the second volume is smaller than the first volume.

3. The apparatus of claim 2, wherein said movable push rod is actuated manually.

4. The apparatus of claim 2, wherein said movable push rod is actuated by a hydraulic cylinder.

5. The apparatus of claim 1, wherein:

said paper placement platform comprises a U-shaped assembly comprising a bottom, a first side extending upwardly from said bottom, and a second and opposing side extending upwardly from said bottom;

wherein said first side comprises a first plurality of adhesive spray nozzles disposed on a surface facing said second side.

6. The apparatus of claim 5, wherein said first plurality of adhesive spray nozzles comprises six adhesive spray nozzles all in fluid communication with an adhesive reservoir.

7. The apparatus of claim 5, wherein said first plurality of adhesive spray nozzles comprises fewer than six adhesive spray nozzles all in fluid communication with an adhesive reservoir.

8. The apparatus of claim 5, wherein said first plurality of adhesive spray nozzles comprises more than six adhesive spray nozzles all in fluid communication with an adhesive reservoir.

9. The apparatus of claim 5, wherein said second side comprises a second plurality of adhesive spray nozzles disposed on a surface facing said first side.

10. The apparatus of claim 5, wherein said second plurality of adhesive spray nozzles comprises fewer than six adhesive spray nozzles all in fluid communication with an adhesive reservoir.

11. The apparatus of claim 5, wherein said second plurality of adhesive spray nozzles comprises more than six adhesive spray nozzles all in fluid communication with an adhesive reservoir.

12. The apparatus of claim 1, wherein:

said one or more adhesives comprise pressure sensitive adhesives;

and said one or more adhesives cure to form an elastomer.

13. The apparatus of claim 12, wherein said elastomer is selected from the group consisting of acrylics, bio-bases acrylate, butyl rubber, ethylene-vinyl acetate with high vinyl acetate content, natural rubber, nitriles, silicone rubbers, styrene block copolymers, styrene butadiene styrene, styrene-ethylene/butylene-styrene, styrene ethylene/propylene, and styrene isoprene styrene.

14. The apparatus of claim 1, wherein: said one or more adhesives comprise hot-melt adhesives; and said one or more adhesives cure to form a polymeric material.

15. The apparatus of claim 1, wherein said one or more adhesives are selected from the group consisting of ethylene-vinyl acetate, polyolefins, polyamides, polyesters, thermoplastic polyurethane, polyurethanes, styrene block copolymers, polycaprolactone with soy protein, polycarbonates, fluoropolymers, silicone rubbers, and polypyrrole.

* * * * *